US006414233B1

(12) United States Patent
Hogue et al.

(10) Patent No.: US 6,414,233 B1
(45) Date of Patent: Jul. 2, 2002

(54) PICK-UP ASSEMBLY FOR STRINGED MUSICAL INSTRUMENTS

(76) Inventors: John H. Hogue, 6051 Sierra Pass, Flint, MI (US) 48532; Larry J. Hogue, 5487 Cottonwood Dr., Swartz Creek, MI (US) 48473

( * ) Notice: Subject to any disclaimer, the term of this patent is extended or adjusted under 35 U.S.C. 154(b) by 0 days.

(21) Appl. No.: 09/788,733

(22) Filed: Feb. 20, 2001

(51) Int. Cl.[7] ..... G10H 3/00

(52) U.S. Cl. ..... 84/723; 84/725; 84/726; 84/728

(58) Field of Search ..... 84/723, 725, 726, 84/728, 727

(56) References Cited

U.S. PATENT DOCUMENTS 3,541,219 A * 11/1970 Abair ..... 84/727
4,581,974 A * 4/1986 Fender ..... 84/725
5,668,520 A * 9/1997 Kinman ..... 336/84 R

* cited by examiner

*Primary Examiner*—Shih-Yung Hsieh
(74) *Attorney, Agent, or Firm*—Brooks & Kushman, P.C.

(57) ABSTRACT

A pick-up assembly for a stringed musical instrument includes first and second identical pick-ups in respective housings. The first pick-up is positioned toward strings of the instrument and the second pick-up is positioned toward inside of the instrument. The first and second pick-ups are attached back to back with a hard rubber sound suppressing material sandwiched between the back of the two housings. The sound suppressing material has the same size as the back of the housing. The second pick-up is grounded with a metal wire.

7 Claims, 1 Drawing Sheet

PICK-UP ASSEMBLY FOR STRINGED MUSICAL INSTRUMENTS

BACKGROUND OF THE INVENTION

1. Field of the Invention

The invention is related to pick-ups for stringed musical instruments such as guitars and, more particularly, to a pick-up assembly having two pick-ups with a sound suppressing material.

2. Background Art

There has been a problem with musical instrument pick-ups and amplifiers for many years in slab body type guitars and string musical instruments. When people started coming out to hear musical concerts in large numbers, musicians started turning the volume up on their instruments, so that all the people in the back row could hear them. The instruments started picking up harmonics and sound waves not pleasing to the human ear. The manufacturers started building slab or solid body instruments to help eliminate the undesired tones. To make the sounds more perfect the tones should be eliminated. The invention addresses this problem, and eliminates the need for solid body instruments, for those who do not like the harsh sound of a solid body instrument. The invention will solve this problem.

SUMMARY OF THE INVENTION

The broad purpose of this invention is to improve the tone of musical instruments by eliminating undesired frequencies or notes, and tones before they are amplified by pick-ups and amplifiers.

Guitars and instruments that have electrical pick-ups have problems. The pick-up or string amplifier, amplifies all sound waves that hit the string pick-up. This invention will suppress that sound wave that strike the string pick-up from the backside and will eliminate the sound wave thereby eliminating the need for solid body instruments.

DETAILED DESCRIPTION OF THE PREFERRED EMBODIMENT(S)

Figure 1:
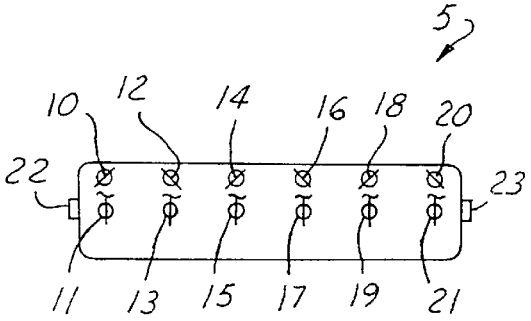
(PRIOR ART) FIG. 1
FIG. 1 illustrates a drawing of the Humbucking pick-up and housing used on instruments today.

Referring to FIG. 1, a pick-up and tuner amplifier 5 is shown. Pick-up 5 is a Humbuckler pick-up tuner and includes a housing, big E string pick-up 10, big E string 11, A string pick-up 12, D string pick-up 14, D string 15, G string pick-up 16, G string 17, B string pick-up 18, B string 19, E string pick-up 20, E string 21, big E string side of the housing and pick-up, housing bracket screwed to the guitar 22 and little E string side of the bridge and pick-up screwed to the guitar 23.

Figure 2:
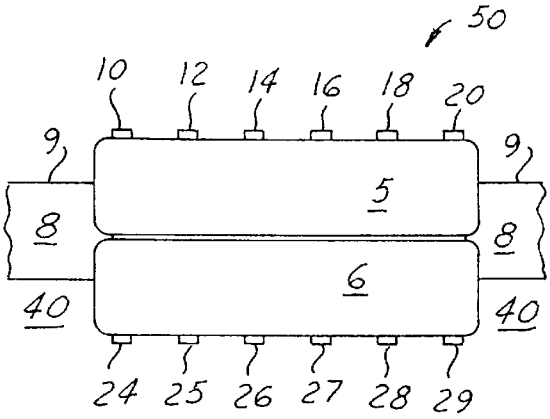
FIG. 2 illustrates a pick-up assembly attached to a stringed musical instrument such as a guitar in accordance with the invention.

Referring to FIG. 2, a pick-up assembly 50 in accordance with the invention is shown. Pick-up assembly 50 includes two like pick-ups 5 and 6. Pick-ups 5 and 6 are attached back to back to the underside of the other respective pick-up. Second pick-up 5 includes big E string pick-up $2^{nd}$ tuner pick-up 24, A string pick-up 25, D string pick-up 26, G string pick-up 27, B string pick-up 28, and little E string pick-up 29. First and second pick-ups 5 and 6 of pick-up assembly 50 are attached back to back with screws, glue, or the like. As shown in FIG. 2 and with reference to FIG. 5, first pick-up 5 faces the strings of musical instrument 8 and second pick-up faces interior 40 of the musical instrument. One of first and second pick-ups 5 and 6 is tuned to zero amplification, or is grounded out through a shielded wire that returns to a power source.

Figure 3:
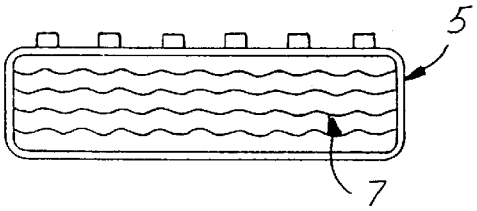
FIG. 3 illustrates a sound suppressing material in a cavity underneath the under side of a pick-up of the pick-up assembly in accordance with the invention.

Referring to FIG. 3, a piece of material such as lead or any sound suppressing material 7 within the housing of a pick-up such as pick-up 5 is shown. Sound suppressing material 7 is a hard rubber material or the like which is sized to fit the cavity in the housing of pick-up 5. Sound suppressing material 7 is attached to the underside of the housing of pick-up 5. The thickness of sound suppressing material 7 is determined by the material used.

Figure 4:
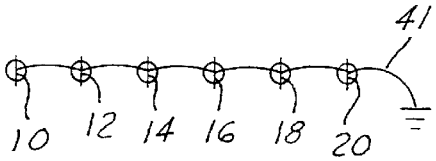
FIG. 4 illustrates a wire attached by soldering to each pick-up and grounded to the shield of the wires running to the main amplifier and electrical system of a pick-up of the pick-up assembly in accordance with the invention.

Referring to FIG. 4, a conductive wire 41 attaching elements 10, 12, 14, 16, 18 and 20 of pick-up 5 together for grounding undesired frequencies or notes is shown.

Figure 5:
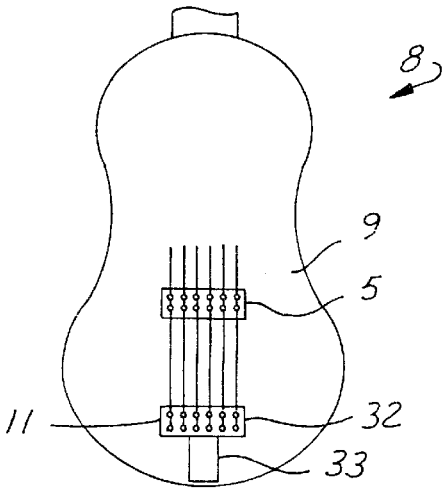
FIG. 5 illustrates the top of the guitar and the pick-up assembly shown in FIG. 2.

Referring to FIG. 5, the of the guitar cavity showing the bridge housing is shown. Guitar 8 includes a bridge 32, a tail piece and bridge 33, and a tuner housing and pick-up 5 facing away from exterior surface 9 of guitar 8. Second pick-up 6 of pick-up assembly 50 is contained within interior 40 of guitar 8 underneath first pick-up 5 in accordance with the invention.

Having described our invention we claim:

1. A pick-up assembly for a stringed musical instrument comprising:

a first pick-up in a housing, the first pick-up being positioned toward strings of the instrument; and a second identical pick-up in a housing, the second pick-up being positioned toward inside of the instrument;

wherein the first pick-up and the second pick-up are attached back to back with a hard rubber sound suppressing material sandwiched between the back of the two housings, the sound suppressing material having the same size as the back of the housing, and the second pick-up being grounded with a metal wire.

2. A pick-up assembly for a stringed musical instrument comprising:

a first pick-up in a housing, the first pick-up being positioned toward strings of the instrument; and a second pick-up in a housing, the second pick-up being positioned toward inside of the instrument;

wherein the first pick-up and the second pick-up are attached back to back with a rubber sound suppressing material sandwiched between the back of the two housings.

3. The pick-up assembly of claim 2 wherein:

the first pick-up and the second pick-up are identical.

4. The pick-up assembly of claim 2 wherein:

the second pick-up is grounded.

5. The pick-up assembly of claim 4 wherein:

the second pick-up is grounded with a metal wire.

6. A pick-up assembly for a stringed musical instrument comprising:

a first pick-up in a housing, the first pick-up being positioned toward strings of the instrument; and a second pick-up in a housing, the second pick-up being positioned toward inside of the instrument;

wherein the first pick-up and the second pick-up are attached back to back with a sound suppressing material sandwiched between the back of the two housings, wherein the sound suppressing material has the same size as the back of the two housings.

7. The pick-up assembly of claim 6 wherein:

the sound suppressing material includes a rubber sound suppressing material.

* * * * *